US006073287A

United States Patent [19]

Svensson

[11] Patent Number: 6,073,287

[45] Date of Patent: Jun. 13, 2000

[54] RESCUE DEVICE

[75] Inventor: Hans Svensson, Helsingborg, Sweden

[73] Assignee: Investment AB Falneria, Sweden

[21] Appl. No.: 09/117,360

[22] PCT Filed: Jan. 24, 1997

[86] PCT No.: PCT/SE97/00119

§ 371 Date: Apr. 12, 1999

§ 102(e) Date: Apr. 12, 1999

[87] PCT Pub. No.: WO97/26852

PCT Pub. Date: Jul. 31, 1997

[30] Foreign Application Priority Data

Jan. 26, 1996 [SE] Sweden ..... 9600355

[51] Int. Cl.[7] ..... A61G 1/013

[52] U.S. Cl. ..... 5/625; 5/627; 441/83

[58] Field of Search ..... 5/625, 626, 627, 5/628; 441/83, 129

[56] References Cited

U.S. PATENT DOCUMENTS

| | | | |
|---|---|---|---|
| Re. 28,916 | 7/1976 | Rice et al. | 5/628 |
| 2,015,391 | 9/1935 | Anderson | 5/627 |
| 2,738,939 | 3/1956 | Johnson | 441/83 X |
| 3,406,410 | 10/1968 | Bidgood | 5/625 |
| 3,414,914 | 12/1968 | Gramins | 5/627 |
| 3,663,972 | 5/1972 | Denton | 5/625 |
| 3,707,734 | 1/1973 | Matthews | 5/627 X |
| 3,775,782 | 12/1973 | Rice et al. | 5/628 X |
| 4,466,145 | 8/1984 | Jones et al. | 5/626 X |
| 5,121,514 | 6/1992 | Rosane | 5/628 |
| 5,189,746 | 3/1993 | Horie | 5/627 |
| 5,745,938 | 5/1998 | Bartley et al. | 5/627 X |
| 5,862,547 | 1/1999 | Bartley et al. | 5/627 X |

FOREIGN PATENT DOCUMENTS

| | | | |
|---|---|---|---|
| 0 123 474 A2 | 4/1984 | European Pat. Off. . | |
| L 1134584 | 11/1968 | France . | |
| 616678 | 8/1935 | Germany | 5/626 |
| 3937174 | 5/1991 | Germany | 5/628 |
| 9300580 | 5/1994 | Sweden . | |
| 1581311 | 7/1990 | U.S.S.R. | 5/628 |
| WO 87/04614 | 8/1987 | WIPO . | |

*Primary Examiner*—Terry Lee Melius
*Assistant Examiner*—Robert G. Santos
*Attorney, Agent, or Firm*—Fasth Law Offices; Rolf Fasth

[57] ABSTRACT

The rescue device comprises a first sheet member and two second sheet members that are disposed on each side of the first sheet member. The second sheet members are angled relative to the first sheet member to define an angle alpha. The rescue device has a plurality of carrying means enabling the device to be carried. The first and second sheet members each has a stable first sheet and a resilient and thermally insulating second sheet that has closed pores and a third sheet that is disposed adjacent ot the second sheet.

8 Claims, 2 Drawing Sheets

17cm

RESCUE DEVICE

The present invention relates to a rescue device intended for use in traffic accidents and also in accidents at sea that involve man overboard situations.

It is a common occurrence in traffic accidents that the vehicles involved, for instance cars, are so demolished as to render it impossible to remove injured persons from the vehicles in the normal way. In these situations, the rescue personnel cut-away the vehicle in a manner suitable with respect to the situation on hand, whereafter the injured persons are removed from the vehicle and often placed on a stretcher, depending on the nature of their injuries. Such movement of the injured person is a critical step in this procedure, since the person concerned may be unconscious and the rescue personnel may not be aware of the injuries sustained by the person. His/her injuries may be worsened in the worst of cases.

In the case of accidents at sea that involve man overboard situations, it is often difficult to rescue a person in the water from a boat. The problem is one of lifting the person from the water and place him/her in the rescue boat. The person in the water is often heavy to lift, due to the sodden state of the person's clothing, while lifting is made even more difficult when the person concerned is unconscious. In the case of man overboard situations, it is very important to take-up the person concerned as quickly as possible, since the human body cools down very rapidly when submerged in water, particularly when the water has a low temperature.

A further problem that occurs in the aforesaid situations is that the rescue devices used will preferably be made of a material that will not absorb fluid, such as water and blood, for instance.

SUMMARY OF THE INVENTION

The object of the present invention is to solve the aforesaid problems. This object is achieved with a rescue device according to claim 1. The rescue device comprises an elongated sheet-like structure on which an injured person is placed, a plurality of tubular members that are disposed in the longitudinal direction of the sheet-like member and function to reinforce the device, and a plurality of carrier elements by means of which the device can be carried. The sheet-like structure of the rescue device includes a first stable sheet which braces the structure, a resilient second layer having closed pores located adjacent the first sheet, and a third, smooth sheet which is disposed adjacent the second sheet centrally opposite the first sheet. The third sheet is the sheet on which the injured person is placed and because even the resilient sheet is made of a material having closed pores, the sheet-like member will not absorb fluid. The inventive rescue device also includes securing or fastening means on the first sheet which enable the device to be secured to the railings of a boat, buoyancy means disposed on the first sheet-like sheet, gas supply means connected to the buoyancy means, and an activator connected to the gas supply means and functioning to fill the buoyancy means with gas from the gas supply means so that the rescue device will be made buoyant.

Because the inventive rescue device is constructed in the aforedescribed manner, it is suitable for use in traffic accidents and also in accidents at sea which involve man overboard situations. Furthermore, the inventive rescue device will not absorb fluid.

DETAILED DESCRIPTION OF PREFERRED EMBODIMENTS OF THE PRESENT INVENTION

Figure 1:
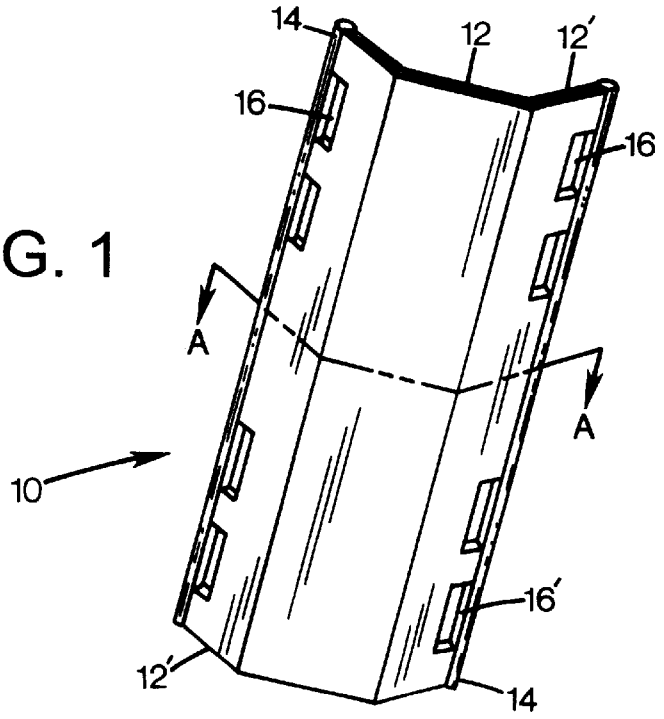
FIG. 1 is a perspective view of an inventive rescue device.
Figure 2:
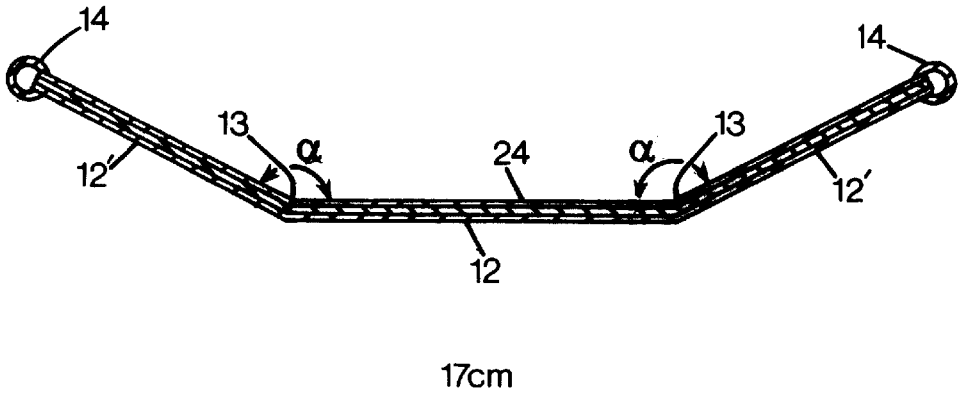
FIG. 2 is a cross-sectional view of the rescue device shown in FIG. 1, said view being taken on the line A—A in FIG. 1.

FIG. 1 is a perspective view of an inventive rescue device 10, and FIG. 2 is a cross-sectional view of the rescue device 10 taken on the line A—A in FIG. 1. The rescue device 10 includes an elongated sheet structure 12, 12' which preferably comprises a first sheet member 12 and two second sheet members 12' disposed on a respective side of the first sheet member 12. As will be evident from FIG. 2, the second sheet members 12' are angled so as to define an angle $\alpha$ with the first sheet member 12. The angle $\alpha$ will preferably be about 110°. The angle $\alpha$ is produced by bending the sheet member 12, 12' along two parallel longitudinally extending lines 13, as evident from FIG. 2. The rescue device 10 also includes tubular members 14 that are disposed around the sheet member 12, 12' and that have the double purpose of stabilizing the rescue device and of forming an "intermediary" between the carrier and the sheet member 12, 12'. Instead of being tubular, the member 14 may be a strip or a rod. The tubular members 14 are intended to brace or reinforce the rescue device 10. As evident from FIG. 1, the rescue device 10 also includes a plurality of carrying means 16 which are disposed on the second sheet members 12' and by means of which the device 10 can be carried. In the illustrated embodiment, the carrying means 16 have the form of apertures 16 in the second sheet members 12' and are disposed at the outer edges of the tubular members 14, so that said members can also be used in carrying the rescue device 10. The FIG. 1 embodiment includes four apertures 16 on each long side of the rescue device 10, although it will be understood that these apertures may preferably be two or more in number. The rescue device 10 will preferably have a length of 140 cm. As evident from FIG. 2, the first sheet member 12 has a width of preferably about 17 cm, whereas the second sheet members 12' preferably have a width of about 13 cm. This gives the rescue device 10 a total width of about 40 cm between its longitudinally extending outer edges.

Figure 3:
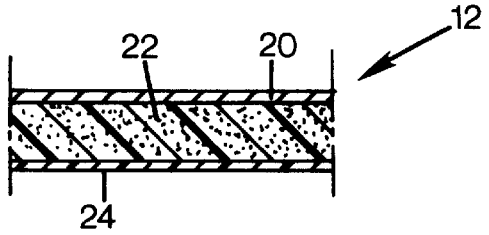
FIG. 3 is a cross-sectional view of the sheet-like structure used in the inventive rescue device.

FIG. 3 is a cross-sectional view of the sheet structure 12, 12' used in the inventive rescue device 10. The sheet structure 12, 12' includes a first stable sheet 20 which is intended to brace or reinforce the sheet structure 12, 12', and therewith the rescue device 10. The sheet structure further includes a resilient and heat-insulating second sheet 22 having closed pores and disposed on the first sheet member 20, and a third, smooth sheet member 24 which delimits the second sheet member 22 and lies opposite the first sheet member 20. The third sheet member 24 is the sheet member on which the injured person is placed. The first sheet member 20 will preferably be rigid and strong, and may conveniently be comprised of aluminium sheets having a thickness of 2 mm. This will further add to the stability of the rescue device 10. The second sheet member 22, i.e. the intermediate sheet member, may be comprised of interbound polyethylene foam having dense cells. The second sheet member 22 is also slit along the two longitudinally extending lines 13, so as to facilitate bending of the sheet structure 12, 12' along said lines 13. The second sheet member will have a thickness of about 3–9 mm and a density of about 0.05 kg/m$^3$. The third sheet member 24 will preferably be sufficiently rigid to prevent it being deformed to any appreciable extent by punctiform loads, although sufficiently soft to prevent the rescued person from suffering further injury due to insignificant impact forces. The surface of the third sheet member 24 will preferably also be such as to enable the injured person to be readily drawn or pulled along said surface. The third sheet member 24 may comprise a non-porous polyethylene sheet having a density of about 0.9–1.0 kg/m$^3$ and a thickness of about 0.6–1.5 mm. The third sheet member 24 lies proximal to the concave part of the rescue device 10.

A sheet structure 12, 12' of the aforedescribed construction provides a rescue device 10 that will counteract displacement of skeletal parts of the rescued person as the person is drawn or pulled along the rescue device 10. Because the rescue device 10 will yield to a certain extent, the rescued person will not suffer contusions when handled roughly. The rescue device 10 is also thermally insulating, thereby preventing the body of the rescued person being cooled down when the rescue device 10 is placed on the ground with the rescued person lying on said device. Neither will the rescue device 10 absorb fluids, such as body fluids and cleaning liquids.

The aforedescribed rescue device 10 can be used in conjunction with traffic accidents. A hypothetical traffic accident is described below.

Assume that a traffic accident has occurred between two automotive vehicles, for instance two cars, with only one person in each vehicle, and that the cars have been wrecked to such an extent as to make it impossible for the rescue personnel to open the doors of said cars. The rescue personnel begin by cutting away the roof of the cars with the aid of an appropriate tool. The rescue device 10 is then passed through the hole in the roof such as to position the device between the injured person and the car seat, with the first sheet member 20 made, for instance, of aluminium placed against the seat and the third sheet member 24, made for instance of a relatively rigid plastic material, placed against the injured person. The first sheet member 12 therewith functions as a support in the back and front sheet members, and the second sheet members 12' form a "hollow" that constrains lateral movement of the body. The next step is to draw the injured person along the rescue device 10, so that the person concerned will "lie" on said device 10, or rather "incline" on said device 10, since the device 10 is probably substantially parallel with the backrest of the seat. The rescue device 10 is then tilted along an imaginary axis so as to be essentially horizontal, with the injured person lying on said device, whereafter the rescue device 10 is used in the manner of a stretcher. The injured person is preferably secured to the rescue device 10 in this position by means of securing devices (not shown). These securing devices may have the form of straps, for instance. The next step is to remove the rescue device 10 and the person secured thereto from the car for transportation to an ambulance for instance, this normally being effected by carrying the device 10 by the carrying means 16.

The inventive rescue device 10 may also be used in rescue operations at sea in man overboard situations. This is described below with reference to an hypothetical boat accident.

Figure 4:
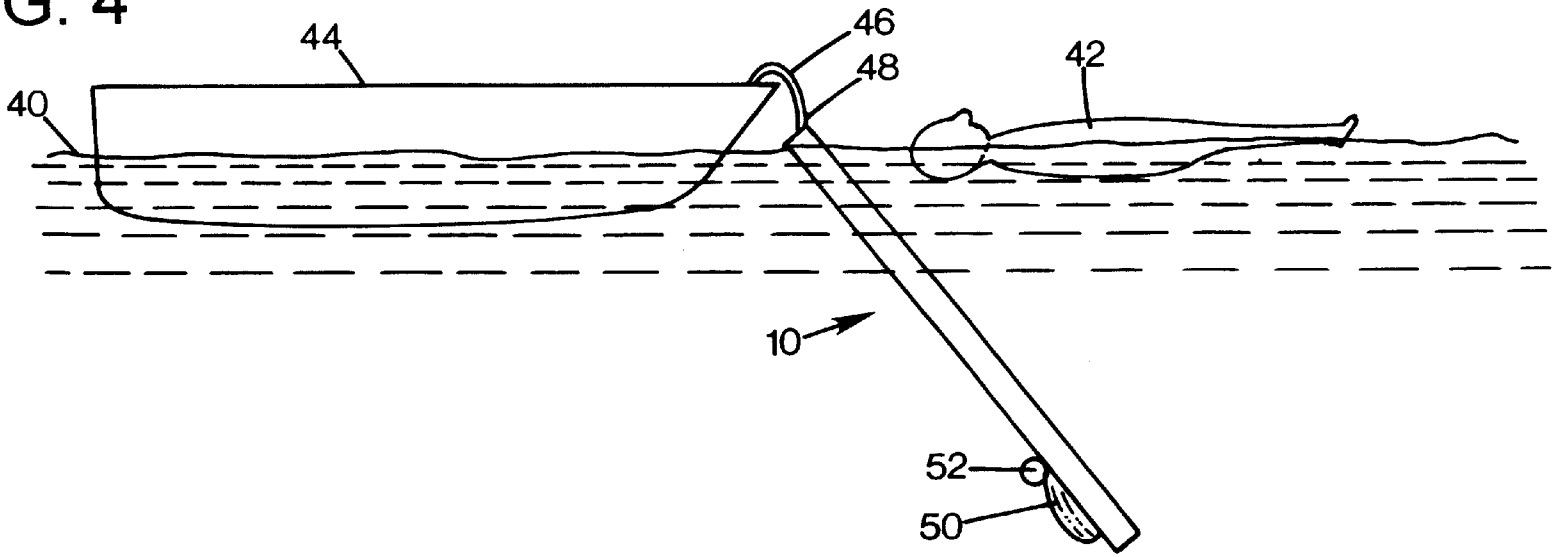
FIG. 4 is a first schematic illustration of the manner in which the inventive rescue device can be used in man overboard situations.
Figure 5:
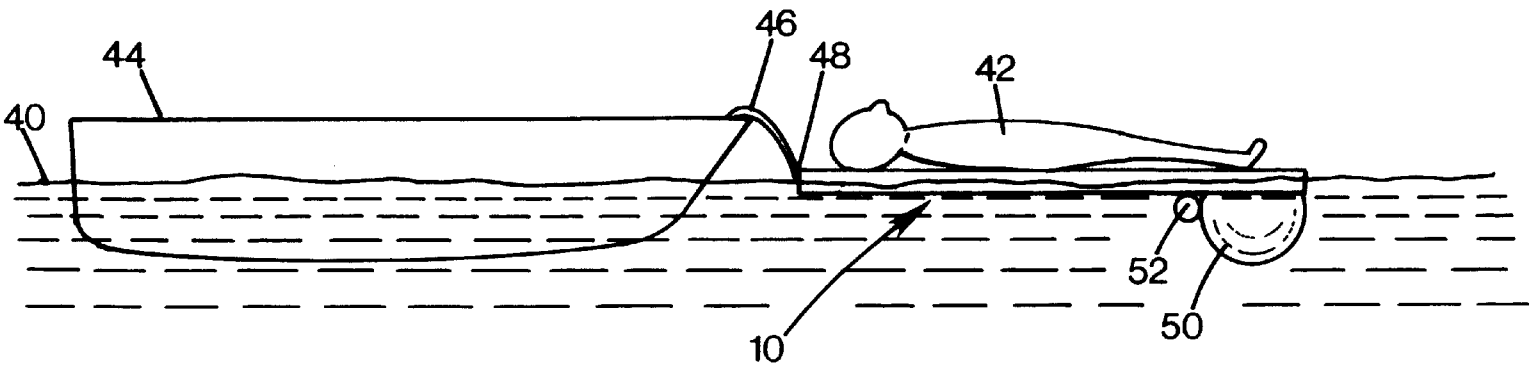
FIG. 5 is a second schematic illustration of the manner in which the inventive rescue device can be used in man overboard situations.

Assume that a boat accident occurs in which the driver of the boat is alone and falls overboard and is knocked unconscious in the event. Also assume that a rescue boat equipped with inventive rescue devices 10 is called to the place of the accident for the purpose of rescuing the injured person, who lies unconscious in the water. So that the use of the rescue device 10 in this situation will be understood more readily, reference is made to FIGS. 4 and 5. FIG. 4 shows the injured person 42 floating unconscious in the water 40. The rescue boat 44 with rescue personnel on board has reached the injured person 42 and lowered a rescue device 10 into the water. As evident from FIG. 4 for instance, the rescue device 10 includes an attachment means 46 for attaching the device 10 to the railing of the rescue boat 44. The attachment means 46 may have the form of a hook attached to one short end of the first sheet member 12 (c.f. FIGS. 1 and 2) by means of a hinge device 48 that will enable the first sheet member 12 to be swung along the axis line of the hinge device 48 in relation to the attachment means 46. The rescue device 10 also includes at the other end of the first sheet member 12 a buoyancy means 50, a gas source 52 that contains gas and is connected to the buoyancy means 50, and an activating device (not shown) connected to the gas source 52. The rescue boat 44 is manoeuvred so that the injured person 42 floats above the rescue device 10 with said device submerged in the water 40 beneath the injured person 42. The rescue personnel in the boat 44 then activates the activating device which, in turn, actuates the gas source 52 so as to fill the buoyancy means 50 with gas and therewith render the same buoyant. FIG. 5 shows the situation in which the buoyancy means 50 is inflated to a maximum extent, wherewith the rescue device 10 will, in principle, float horizontally with the injured person 42 lying on said device 10. The injured person 42 is suitably secured on the rescue device 10 in this position by means of securing devices (not shown) of the same kind as the aforementioned. The buoyancy means 50 may be a balloon made of impact-durable material and having a size which will keep the rescue device 10 and a person placed thereon afloat when the balloon is inflated and when the rescue device 10 is disposed in the manner shown in FIGS. 4 and 5. The gas source 52 may be a cylinder filled with carbon dioxide gas, for instance. The activating means may be an electrical or mechanical means.

In another embodiment of the present invention, the rescue device 10 includes buoyancy means 16' (c.f. FIG. 1) that have a shape which enables them to fit into the aperture 16 provided in the rescue device 10. The buoyancy means 16' of this embodiment have the form of inserts 16' mounted in and secured to respective apertures 16 when the rescue device 10 needs to be used in conjunction with an accident at sea. Thus, an appropriate number of buoyancy means 16' may be selectively mounted on the rescue device 10, the number of buoyancy means used depending on the weight of the person to be rescued, for instance. When the inserts 16' are not mounted on the rescue device 10, the buoyancy means 16' will probably not be in an active state, i.e. will not be inflated. On the other hand, when the inserts 16' are mounted on the rescue device 10 and secured thereto, the buoyancy means 16' will be brought to an active state, i.e. inflated to a maximum. The insert 16' can be removed from the aperture 16 subsequent to having used the rescue device 10 to rescue a person who has fallen overboard, for instance.

The inventive rescue device has been described in the aforegoing with reference to preferred embodiments thereof. It will be understood that these embodiments do not limit the scope of the invention and that variations and modifications can be made within the scope of the following claims.

What is claimed is:

1. A rescue device for use in traffic accidents or in accidents at sea, comprising:

an elongated sheet structure on which an injured person is placed, a number of tubular members disposed around the sheet structure and functioning to reinforce or brace the rescue device, and a number of carrying means disposed on the sheet structure to enable the rescue device to be carried the sheet structure comprises a first stable sheet intended to brace the sheet structure, a thermally insulating second sheet having closed pores and disposed adjacent the first sheet and a substantially smooth third sheet disposed adjacent to the second sheet and opposite the first sheet, wherein the third sheet is the sheet on which the injured person is placed, the sheet structure being a unit comprising a first sheet member and two second sheet members having been produced by bending the sheet structure along two longitudinally extending lines and each of which being disposed on a respective side of and along the longitudinally extending sides of the first sheet member, the second sheet members defining an angle ($\alpha$) with the first sheet member, and the second sheet being slit alone the two longitudinally extending lines.

2. A rescue device according to claim 1 wherein the carrying means has apertures defined therein disposed adjacent to the tubular members in the two second sheet members.

3. A rescue device according to claim 2 wherein the device also includes an attachment means mounted at one short end of the first sheet member and functioning to attach the device to the railing of a boat, a buoyancy device mounted at the other end of the first sheet member, a gas-containing gas source connected to the buoyancy device, and an actuator connected to the gas source, wherein activation of the actuator causes gas to be delivered from the gas source to the buoyancy device so as to achieve buoyancy.

4. A rescue device according to claim 2 wherein the device (10) also comprises insert devices that are intended to be mounted in and fastened to the apertures, wherein the insert devices include buoyancy means which are inflated in an activated state to achieve buoyancy.

5. A rescue device according to claim 1, characterized in that the first sheet is an aluminium sheet, the second sheet is a foamed plastic sheet; and in that the third sheet is made of a relatively rigid plastic material.

6. A rescue device according to claim 1 wherein the angle ($\alpha$) is about 110°.

7. A rescue device according to claim 3 wherein the device also includes hinge means between the first sheet member and the attachment means for enabling the first sheet member to be pivoted in relation to the attachment means.

8. A rescue device according to claim 3 wherein the attachment means is a hook, in that the buoyancy device is a balloon and in that the gas source is a carbon dioxide cylinder.

* * * * *